US007029092B2

(12) United States Patent
Edamura et al.

(10) Patent No.: US 7,029,092 B2
(45) Date of Patent: Apr. 18, 2006

(54) INK-JET PRINTING APPARATUS AND PRELIMINARY DISCHARGE CONTROL METHOD FOR THE APPARATUS

(75) Inventors: Tetsuya Edamura, Kanagawa (JP); Hiroshi Tajika, Kanagawa (JP); Yuji Konno, Kanagawa (JP); Norihiro Kawatoko, Kanagawa (JP); Takayuki Ogasahara, Rochester, NY (US); Atsuhiko Masuyama, Kanagawa (JP); Akiko Maru, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 195 days.

(21) Appl. No.: 10/640,048

(22) Filed: Aug. 14, 2003

(65) Prior Publication Data

US 2004/0104974 A1 Jun. 3, 2004

(30) Foreign Application Priority Data

Aug. 29, 2002 (JP) ..... 2002-251445

(51) Int. Cl.
*B41J 2/165* (2006.01)

(52) U.S. Cl. ..... 347/30; 347/35

(58) Field of Classification Search ..... 347/10, 347/12, 20, 30, 33, 34, 35, 15, 29
See application file for complete search history.

(56) References Cited

U.S. PATENT DOCUMENTS

| | | | | |
|---|---|---|---|---|
| 4,313,124 | A | 1/1982 | Hara | 346/140 R |
| 4,345,262 | A | 8/1982 | Shirato et al. | 346/140 R |
| 4,459,600 | A | 7/1984 | Sato et al. | 346/140 R |
| 4,463,359 | A | 7/1984 | Ayata et al. | 346/1.1 |
| 4,558,333 | A | 12/1985 | Sugitani et al. | 346/140 R |
| 4,723,129 | A | 2/1988 | Endo et al. | 346/1.1 |
| 4,740,796 | A | 4/1988 | Endo et al. | 346/1.1 |
| 5,614,931 | A * | 3/1997 | Koike et al. | 347/43 |
| 6,079,809 | A | 6/2000 | Yaegashi et al. | 347/35 |
| 6,145,956 | A | 11/2000 | Koitabashi et al. | 347/30 |
| 6,257,696 | B1 | 7/2001 | Nakamura | 347/30 |

OTHER PUBLICATIONS

Search Report, dated Feb. 12, 2004, in EP 03 01 9478.
U.S. Appl. No. 10/648,300 (Yazawa et al.), filed Aug. 27, 2003.

* cited by examiner

*Primary Examiner*—Lamson Nguyen
(74) *Attorney, Agent, or Firm*—Fitzpatrick, Cella, Harper & Scinto

(57) ABSTRACT

In an ink-jet printing apparatus which includes a plurality of printing heads, each having an array of ink discharging elements, preliminary discharge of driving the elements of at least one printing head is performed a predetermined number of times. The printing head for which the preliminary discharge is to be performed is switched in a predetermined cycle. In performing the preliminary discharge, switching of the printing head is so controlled as to perform preliminary discharge a desired number of times for all the elements of the printing heads by repeating the cycle.

1 Claim, 8 Drawing Sheets

INK-JET PRINTING APPARATUS AND PRELIMINARY DISCHARGE CONTROL METHOD FOR THE APPARATUS

FIELD OF THE INVENTION

The present invention relates to an ink-jet printing apparatus and a preliminary discharge control method for the apparatus and, more particularly, to control when preliminary discharge irrelevant to printing is performed in an ink-jet printing apparatus which comprises a plurality of printing heads each having an array of ink discharging elements, and prints by discharging ink from the elements onto a printing medium.

BACKGROUND OF THE INVENTION

Printers which print information such as a desired character or image on a sheet-like printing medium such as a paper sheet or film are widely used as an information output apparatus in a word processor, personal computer, facsimile apparatus, and the like.

Various methods are known as the printing method of the printer. In recent years, an ink-jet method has particularly received a great deal of attention because the ink-jet method enables noncontact printing on a printing medium such as a paper sheet, easily achieves color printing, and generates little noise. In terms of low cost and easy downsizing, printers generally widely adopt a serial printing arrangement in which a printing head for discharging ink in accordance with desired print information is mounted on a carriage, and printing is performed by reciprocally scanning the printing head in a direction crossing to the feed direction of a printing medium such as a paper sheet.

Many ink-jet printers perform discharge called preliminary discharge irrelevant to printing because of the two following reasons.

First, an inferior discharge occurs when a volatile component (solvent) contained in ink evaporates from the distal end of the nozzle (ink discharging element) of the printing head and ink thickens along with the lapse of time when no printing is performed. In order to prevent such inferior discharge and degradation in printing quality caused by the inferior discharge, preliminary discharge is performed.

Second, the ink-jet printer generally periodically performs suction recovery operation in order to prevent an inferior discharge caused by evaporation of the ink solvent from the distal end of the nozzle. At this time, if nozzles for discharging inks in a plurality of colors are sucked by one cap in a printer having printing heads for discharging inks in a plurality of colors for color printing, sucked inks mix with each other within the cap, are attached to the orifice surfaces of the printing heads, and reversely sucked into the nozzle, resulting in color mixing. Color mixing of ink may also occur in cleaning (wiping) the discharge surface with a cleaning blade or the like.

To prevent printing with color-mixed ink, a method of performing preliminary discharge is widely employed. That is, color-mixed ink is removed by discharge irrelevant to printing.

Timings when preliminary discharge is performed are immediately before the start of printing and during printing. Immediately before the start of printing, preliminary discharge is performed for removing abnormal ink from the distal end of a nozzle, the nozzle is filled with normal ink, and then printing starts. During printing, a time when normal discharge is possible is calculated from conditions such as the temperature of the printing head and the temperature and humidity inside the printer. Preliminary discharge is periodically performed at a time interval equal to or shorter than the calculated time.

Recently, user demands for ink-jet printers grow more and more, and a higher image quality, higher speed, lower cost, and smaller size are required.

To increase the quality, downsizing of ink droplets to be discharged and the use of many ink colors are adopted. Downsizing of ink droplets to be discharged means downsizing of printing dots to be formed on a printing medium, which greatly contributes to reduction in graininess at a highlight portion in a natural image. As for the use of many ink colors, a conventional general ink-jet printer forms an image with four, black (Bk), cyan (C), magenta (M), and yellow (Y) inks. To increase the image quality at a highlight portion and medium-density portion, there is proposed a printer using six inks including light cyan (LC) and light magenta (LM) inks of light tones prepared by decreasing the dye concentration.

To increase the speed, the number of nozzles per color and the driving frequency are increased.

Owing to increases in the numbers of colors and nozzles, the total number of nozzles used for printing greatly increases in comparison with a conventional printer. An arrangement capable of simultaneously discharging ink from all nozzles (full-color full discharge) requires a power supply unit capable of instantaneously supplying a large current to the printing head.

However, the use of such power supply unit is disadvantageous in terms of the cost and size; it becomes difficult to meet user demands for lower cost and smaller size.

Printing is performed by full-color full discharge only upon reception of a special pattern such as solid printing in 1-pass printing. Printing by full-color full discharge occurs very rarely in general printing operation.

From this, a simple, compact, low-cost power supply unit which cannot supply a current necessary for printing by full-color full discharge is mounted. In printing, the number of simultaneously driven nozzles (simultaneous discharge count) is counted. If the count exceeds a simultaneous discharge count corresponding to a current suppliable by the mounted power supply unit, the printer is so controlled as to switch the printing method such that the number of printing passes is increased.

As the driving frequency and the number of nozzles increase, the ink amount supplied from the ink tank to the printing head per unit time also increases. In general, the ink amount suppliable from the ink tank to the printing head per unit time is limited by the mechanical structure. If an ink amount exceeding the limit is supplied, ink is not normally supplied but contains bubbles, resulting in an inferior discharge.

To increase the ink amount suppliable from the ink tank to the printing head, the ink tank and supply channel must be upsized. This leads to high cost and large size, and it also becomes difficult to meet user demands.

In terms of the ink amount suppliable from the ink tank, the driving frequency may be restricted in discharge from all nozzles for each color (single-color full discharge).

For these reasons, it is often difficult to perform preliminary discharge by discharging full-color inks at the maximum driving frequency of the printing head.

In performing preliminary discharge, the driving frequency is set to one at which single-color full discharge is possible. A discharge color is limited, and preliminary discharge is performed a predetermined number of times for the color. After that, the preliminary discharge color is switched to sequentially perform preliminary discharge (sequential preliminary discharge).

However, this sequential preliminary discharge suffers the following problems.

Sequential preliminary discharge is performed for each color without simultaneously performing preliminary discharge for all colors. The time taken from the start to the end of preliminary discharge becomes long.

Color-mixed ink as a result of suction recovery operation or wiping operation on the discharge surface spreads from the nozzle into the liquid chamber. If the time till the start of preliminary discharge becomes long, color-mixed ink spreads into the liquid chamber. Color mixing cannot then be canceled unless a large amount of ink is removed.

That is, in sequential preliminary discharge of performing preliminary discharge for each color, the removal ink amount (preliminary discharge count) must be increased for some inks because such inks wait a longer time than other inks until preliminary discharge actually starts. An increase in ink amount consumed by preliminary discharge leads to an increase in the running cost of the printer

SUMMARY OF THE INVENTION

It is an object of the present invention to provide an ink-jet printing apparatus capable of shortening the time taken for preliminary discharge and reducing the ink consumption amount of preliminary discharge while reducing the size and cost.

It is another object of the present invention to provide a preliminary discharge control method for an ink-jet printing apparatus capable of shortening the time taken for preliminary discharge and reducing the ink consumption amount of preliminary discharge while reducing the size and cost.

According to one aspect of the present invention there is provided an ink-jet printing apparatus which comprises a plurality of printing heads each having an array of ink discharging elements, and prints by discharging ink from the elements onto a printing medium, comprising: preliminary discharge performing means for performing, a predetermined number of times as a unit, preliminary discharge of driving elements of at least one printing head in performing preliminary discharge of discharging ink irrelevant to printing; printing head switching means for switching, in a predetermined cycle, the at least one printing head for which the preliminary discharge is to be performed to other at least one printing head; and control means for controlling the preliminary discharge performing means and the printing head switching means so as to perform the preliminary discharge a desired number of times for all the elements of the printing heads by repeating the predetermined cycle a plurality of times.

According to another aspect of the present invention there is provided an ink-jet printing apparatus which comprises a plurality of printing heads each having an array of ink discharging elements, and prints by discharging ink from the elements onto a printing medium, comprising: preliminary discharge performing means for performing, a predetermined number of times as a unit, preliminary discharge of driving a predetermined number of elements in the printing heads in performing preliminary discharge of discharging ink irrelevant to printing; switching means for switching the predetermined number of elements for which the preliminary discharge is to be performed to other elements of the predetermined number in a predetermined cycle; and control means for controlling the preliminary discharge performing means and the switching means so as to perform preliminary discharge a desired number of times for all the elements of the printing heads by repeating the predetermined cycle.

The objects of the present invention are also achieved by a preliminary discharge control method for an ink-jet printing apparatus, a computer program, and a storage medium that correspond to the ink-jet printing apparatus.

More specifically, according to one aspect of the present invention, in an ink-jet printing apparatus which comprises a plurality of printing heads each having an array of ink discharging elements, and prints by discharging ink from the elements onto a printing medium, preliminary discharge of driving the elements of at least one printing head is performed a predetermined number of times as a unit performs preliminary discharge of discharging ink irrelevant to printing. At least one printing head for which the preliminary discharge is to be performed is switched to other at least one printing head in a predetermined cycle. In performing the preliminary discharge and switching of the printing head are so controlled as to perform preliminary discharge a desired number of times for all the elements of the printing heads by repeating the cycle.

According to another aspect of the present invention, in an ink-jet printing apparatus which comprises a plurality of printing heads each having an array of ink discharging elements, and prints by discharging ink from the elements onto a printing medium, preliminary discharge of driving a predetermined number of elements in the printing heads is performed a predetermined number of times as a unit in performing preliminary discharge of discharging ink irrelevant to printing. The predetermined number of elements for which the preliminary discharge is to be performed are switched in a predetermined cycle. In performing the preliminary discharge and switching of the elements are so controlled as to perform preliminary discharge a desired number of times for all the elements of the printing heads by repeating the cycle a plurality of times.

With this arrangement, a combination of printing heads or the elements of printing heads which are to be driven by one preliminary discharge is so set as to drive the number of simultaneously drivable elements by one preliminary discharge when the power supply of a printing apparatus does not have an ability capable of simultaneously driving all the elements of all the printing heads. The driving cycle in preliminary discharge can be speeded up to the maximum driving frequency of the printing apparatus, and the standby time after the start of preliminary discharge is greatly shortened, compared to a case wherein the printing head used for preliminary discharge is switched after preliminary discharge is performed a desired number of times by one printing head. Further, spread of color-mixed ink into the liquid chamber can be suppressed to increase the removal efficiency of mixed-color ink in preliminary discharge.

Therefore, while the size and cost of the ink-jet printing apparatus are reduced using a simple, compact power supply, the time taken for preliminary discharge can be shortened to reduce the ink consumption amount of preliminary discharge.

The switching means may switch the elements in accordance with a predetermined pattern.

In this case, the predetermined pattern may include a pattern directing from an end portion of the element array to a center.

The predetermined number of times may include 1.

Preferably, the same element is driven in a cycle corresponding to a maximum frequency at which all the elements of one printing head can be simultaneously driven.

The number of elements simultaneously driven by the preliminary discharge performing means may be equal to the number of elements of which a power supply can drive simultaneously.

The predetermined cycle may include a cycle corresponding to a maximum frequency at which the printing head can be driven.

Preferably, the printing is performed by scanning the printing head in a direction crossing to a convey direction of the printing medium.

The element may discharge ink using heat energy, and comprise a thermal transducer for generating heat energy to be applied to ink.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

In the following embodiments, a printer will be described as an example of a printing apparatus for utilizing an inkjet printing system.

In this specification, "print" means not only to form significant information such as characters and graphics, but also to form, e.g., images, figures, and patterns on printing media in a broad sense, regardless of whether the information formed is significant or insignificant or whether the information formed is visualized so that a human can visually perceive it, or to process printing media.

"Print media" are any media capable of receiving ink, such as cloth, plastic films, metal plates, glass, ceramics, wood, and leather, as well as paper sheets used in common printing apparatuses.

Furthermore, "ink" (to be also referred to as a "liquid" hereinafter) should be broadly interpreted like the definition of "print" described above. That is, ink is a liquid which is applied onto a printing medium and thereby can be used to form images, figures, and patterns, to process the printing medium, or to process ink (e.g., to solidify or insolubilize a colorant in ink applied to a printing medium).

First Embodiment

<Brief Description of a Printing Apparatus>

Figure 1:
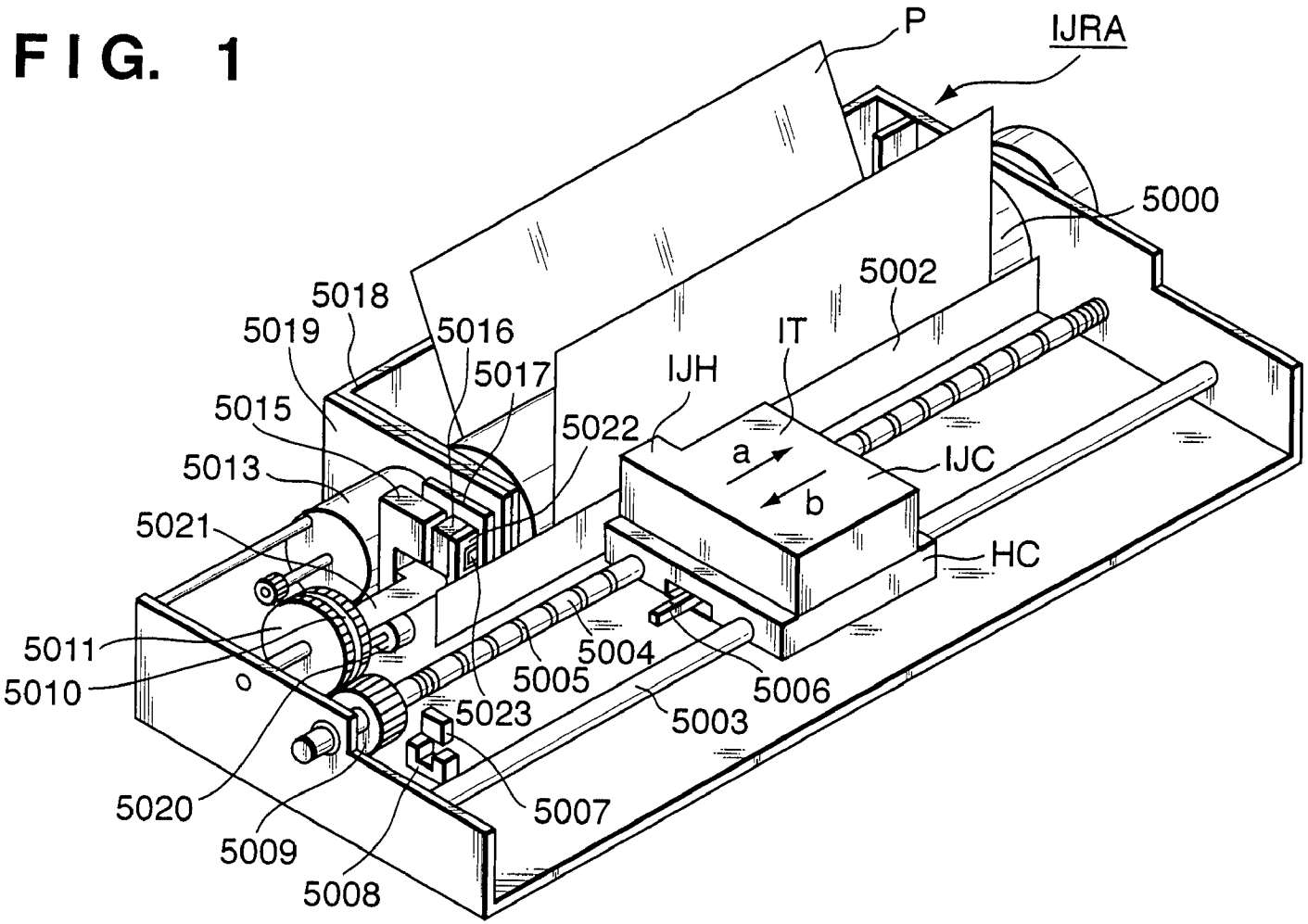
FIG. 1 is a perspective view showing an outer appearance of the construction of a printing apparatus according to the present invention.

FIG. 1 is a perspective view showing the outer appearance of an ink-jet printer (recording apparatus) IJRA as a typical embodiment of the present invention. Referring to FIG. 1, a carriage HC engages with a spiral groove 5005 of a lead screw 5004, which rotates via driving force transmission gears 5009 to 5011 upon forward/reverse rotation of a drive motor 5013. The carriage HC has a pin (not shown), and is reciprocally moved in directions of arrows a and b in FIG. 1. An integrated ink-jet cartridge IJC which incorporates a printing head IJH and an ink tank IT is mounted on the carriage HC.

Reference numeral 5002 denotes a sheet pressing plate, which presses a paper sheet against a platen 5000, ranging from one end to the other end of the scanning path of the carriage. Reference numerals 5007 and 5008 denote photocouplers which serve as a home position detector for recognizing the presence of a lever 5006 of the carriage in a corresponding region, and for switching, e.g., the rotating direction of motor 5013.

Reference numeral 5016 denotes a member for supporting a cap member 5022, which caps the front surface of the printing head IJH; and 5015, a suction device for sucking ink residue through the interior of the cap member. The suction device 5015 performs suction recovery of the printing head via an opening 5023 of the cap member 5015. Reference numeral 5017 denotes a cleaning blade; 5019, a member which allows the blade to be movable in the back-and-forth direction of the blade. These members are supported on a main unit support plate 5018. The shape of the blade is not limited to this, but a known cleaning blade can be used in this embodiment.

Reference numeral 5021 denotes a lever for initiating a suction operation in the suction recovery operation. The lever 5021 moves upon movement of a cam 5020, which engages with the carriage, and receives a driving force from the driving motor via a known transmission mechanism such as clutch switching.

The capping, cleaning, and suction recovery operations are performed at their corresponding positions upon operation of the lead screw 5004 when the carriage reaches the home-position side region. However, the present invention is not limited to this arrangement as long as desired operations are performed at known timings.

<Description of a Control Arrangement>

Next, the control structure for performing the printing control of the above apparatus is described.

Figure 2:
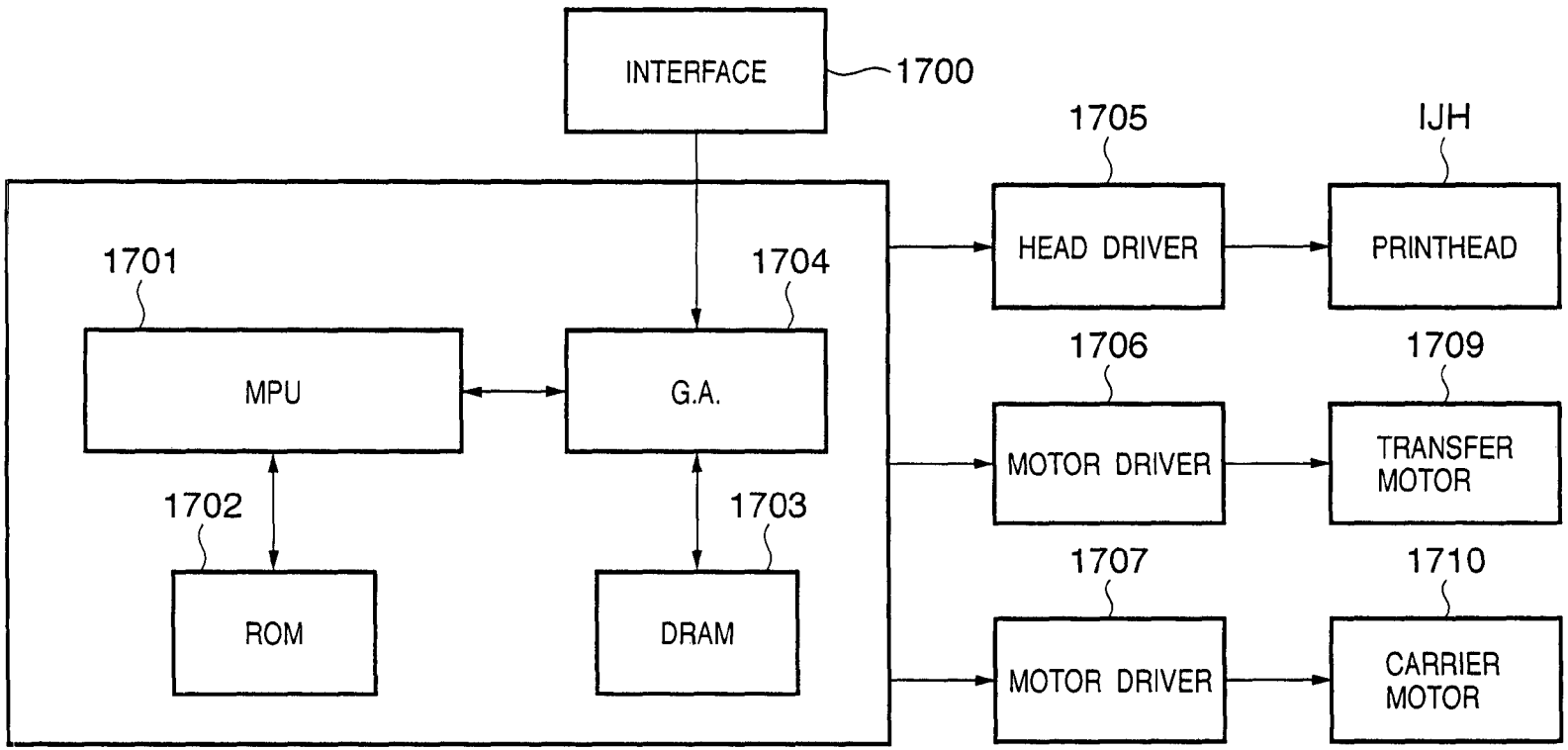
FIG. 2 is a block diagram showing an arrangement of a control circuit of the printing apparatus shown in FIG. 1.

FIG. 2 is a block diagram showing the arrangement of a control circuit of the ink-jet printer. Referring to FIG. 2 showing the control circuit, reference numeral 1700 denotes an interface for inputting a print signal from an external unit such as a host computer; 1701, an MPU; 1702, a ROM for storing a control program (including character fonts if necessary) executed by the MPU 1701; and 1703, a DRAM for storing various data (the print signal, print data supplied to the printing head and the like). Reference numeral 1704 denotes a gate array (G. A.) for performing supply control of print data to the printing head IJH. The gate array 1704 also performs data transfer control among the interface 1700, the MPU 1701, and the RAM 1703. Reference numeral 1710 denotes a carrier motor for transferring the printing head IJH in the main scanning direction; and 1709, a transfer motor for transferring a paper sheet. Reference numeral 1705 denotes a head driver for driving the printing head; and 1706 and 1707, motor drivers for driving the transfer motor 1709 and the carrier motor 1710.

The operation of the above control arrangement will be described below. When a print signal is inputted into the interface 1700, the print signal is converted into print data for a printing operation between the gate array 1704 and the MPU 1701. The motor drivers 1706 and 1707 are driven, and the printing head is driven in accordance with the print data supplied to the head driver 1705, thus performing the printing operation.

Though the control program executed by the MPU 1701 is stored in the ROM 1702, an arrangement can be adopted in which a writable storage medium such as an EEPROM is additionally provided so that the control program can be altered from a host computer connected to the ink-jet printer IJRA.

Note that the ink tank IT and the printing head IJH are integrally formed to construct an exchangeable ink cartridge IJC; however, the ink tank IT and the printing head IJH may be separately formed such that when ink is exhausted, only the ink tank IT need be exchanged for new ink tank.

<Description of an Ink Cartridge>

Figure 3:
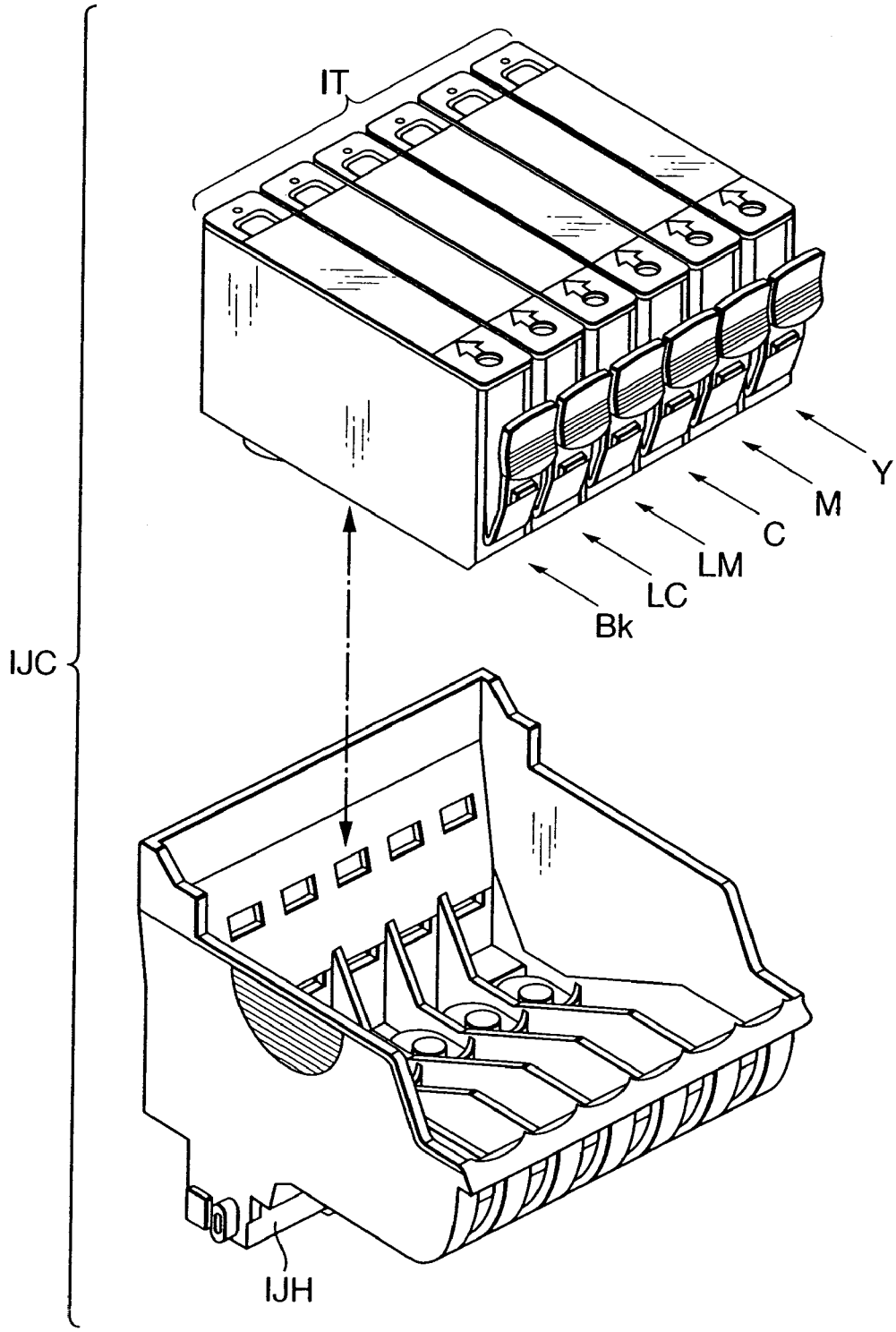
FIG. 3 is a perspective view showing the outer appearance of an ink cartridge which is divided into an ink tank and printing head.

FIG. 3 is a perspective view showing the outer appearance of the ink cartridge IJC which is divided into the ink tank IT and printing head IJH. As shown in FIG. 3, the ink cartridge IJC can be divided into the ink tank IT and printing head IJH. The bottom surface of the ink cartridge IJC on the printing head side is provided with an electrode (not shown) for receiving an electrical signal from the carriage HC when the ink cartridge IJC is mounted on the carriage HC. The printing head IJH is driven by the electrical signal to discharge ink, as described above.

The ink-jet printer of the first embodiment performs color printing using six inks, black (Bk), light cyan (LC), light magenta (LM), cyan (C), magenta (M), and yellow (Y) inks. As shown in FIG. 3, ink tanks corresponding to the respective inks can be independently replaced. Each ink tank IT has a fibrous or porous ink absorber in order to hold ink.

The printing head IJH is formed as a unit of six printing heads on each of which 512 nozzles (ink discharging elements) are arranged in correspondence with each ink. Each printing head can be driven at a frequency of 24 kHz at maximum.

Inks supplied from the ink tank IT to the printing head IJH are guided via a common liquid chamber to liquid channels extending to nozzles. Each liquid channel is equipped with a heater as a heat generating element which generates heat energy. When a driving signal is applied to energize the heater, surrounding ink is abruptly heated to generate bubbles in the liquid channel, and an ink droplet is discharged from a corresponding nozzle by expansion of the bubbles.

<Description of Preliminary Discharge>

Preliminary discharge operation in the first embodiment will be explained in comparison with conventional preliminary discharge operation.

As described above, the maximum driving frequency of the printing head is 24 kHz. In the following description, the maximum driving frequency in discharging single ink from all corresponding nozzles (single-color full discharge) is assumed to be 8 kHz in accordance with the ink supply ability from the ink tank.

The power supply unit (not shown) of the printer is assumed to be able to supply a current capable of simultaneously driving all nozzles (1,024 nozzles) corresponding to two inks.

(Example of Conventional Preliminary Discharge operation)

Figure 4:
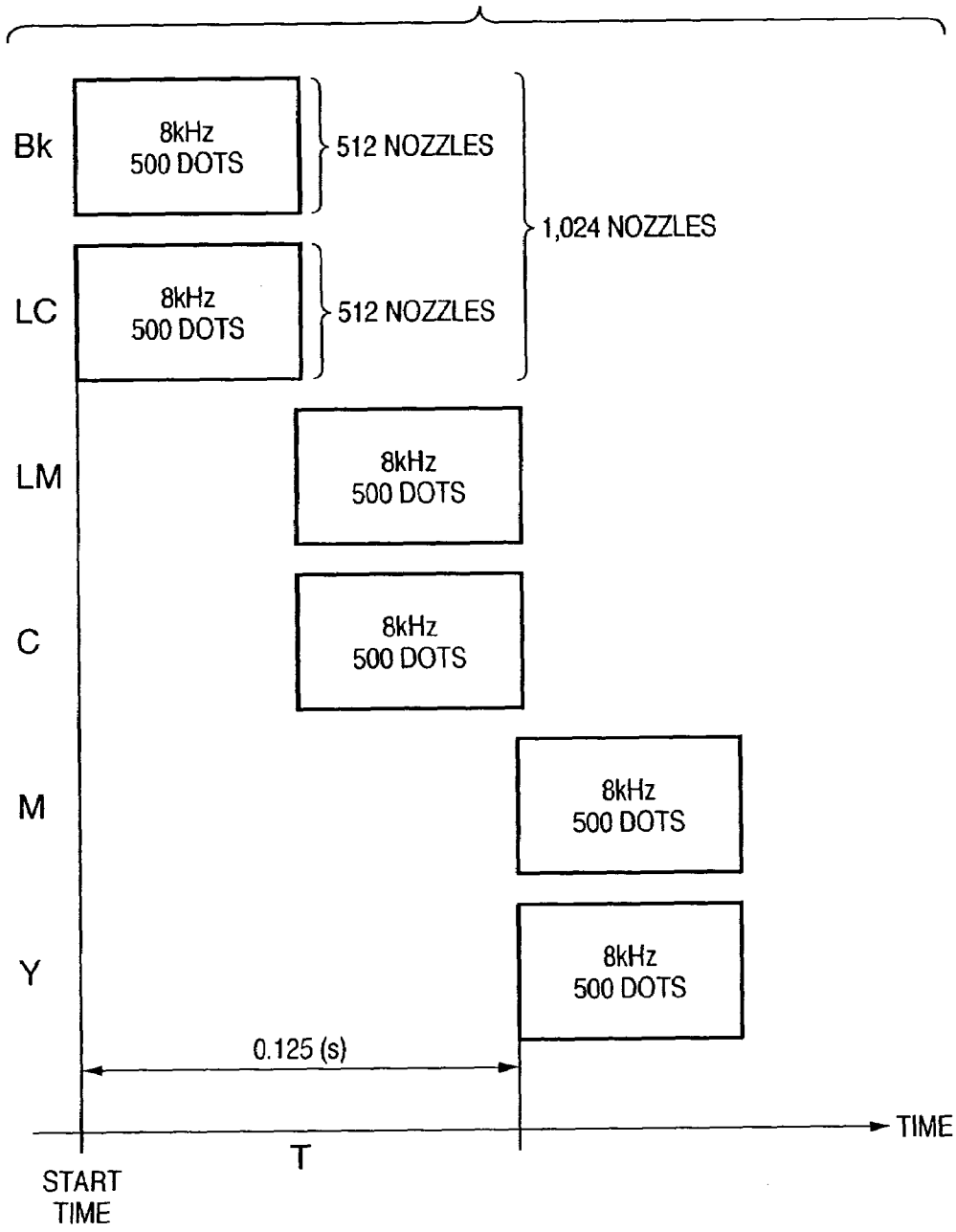
FIG. 4 is a view schematically showing an example of a conventional preliminary discharge operation as time progresses.

FIG. 4 is a view schematically showing an example of a conventional preliminary discharge operation as time progresses. In the example shown in FIG. 4, the preliminary discharge operation is performed by full discharging two-color inks three times with the six inks. In this example, each nozzle performs 500 discharge operations (also referred to as 500 dots).

More specifically, preliminary discharge of 500 dots is first performed by all Bk and LC nozzles (1,024 nozzles) at a driving frequency of 8 kHz. Preliminary discharge of 500 dots is then performed by all LM and C nozzles at a driving frequency of 8 kHz. Finally, preliminary discharge of 500 dots is performed by all M and Y nozzles at a driving frequency of 8 kHz.

When sequential preliminary discharge is performed every two colors, a time of (500+500)/8000=0.125 (sec) lapses until preliminary discharge using M and Y nozzles starts after the start of preliminary discharge using Bk and LC nozzles. During this time, it is highly possible that mixed-color ink spreads from the nozzles into the liquid chamber.

The time taken to end preliminary discharge using all nozzles is $$(500+500+500)/8000=0.1875 \text{ (sec)}$$

(Operation Sequence of First Embodiment)

The printer of the first embodiment performs the following preliminary discharge operation in printing and the suction recovery operation sequence.

1. Printing

If the cap is open when the printer receives a print signal from the host apparatus and is to start printing, a sheet is fed to start printing. If the cap is closed, it is opened, preliminary discharge of 200 dots is performed per nozzle, and a sheet is fed to start printing. This preliminary discharge is performed for removing ink around the nozzle that may be abnormal ink (thickened ink, high-dye-concentration ink, or the like) owing to evaporation of the ink solvent when the printer is left to stand upon capping.

During printing, the time after previous preliminary discharge is measured. Upon the lapse of a predetermined time (5 sec in the first embodiment), after printing/scanning ends, preliminary discharge of 10 dots is performed for the cap per nozzle. This preliminary discharge is performed to prevent an inferior discharge caused by evaporation of the ink solvent from the distal end of the nozzle.

After the end of printing, the carriage is moved to the home position, and the discharge surface is wiped. Wiping removes ink droplets attached to the head discharge surface in printing so as to continue normal discharge. After wiping, preliminary discharge of 500 dots is performed for the cap per nozzle. This preliminary discharge is performed to remove abnormal ink (color-mixed ink or the like) filled in the nozzle by wiping. After the end of preliminary discharge, the pump is driven to remove preliminary discharge ink from the cap while the cap is kept open.

2. Suction Recovery Operation

When the printer receives a suction recovery signal from the host apparatus, suction recovery operation starts. If the cap is open, it is closed, the pump is driven to reduce the pressure in the cap, and ink is sucked from the nozzle. Upon the lapse of a predetermined time, the air communication valve is opened to return the interior of the cap to the atmospheric pressure, and suction ends. Even after that, the pump is driven to remove ink from the cap.

The cap is opened to execute wiping. Wiping removes remaining ink attached to the discharge surface.

Preliminary discharge of 10,000 dots is performed for the cap per nozzle. This preliminary discharge is performed to remove mixed-color ink that enters the nozzle. After performing the preliminary discharge, the pump is driven to remove preliminary discharge ink from the cap while the cap is kept open.

In this manner, in suction recovery operation, mixed-color ink may be produced when remaining ink attached to the discharge surface contacts the nozzle and is sucked into the nozzle owing to a negative pressure in the tank while the pump is driven to remove ink from the cap after the end of suction, and when ink on the discharge surface is forced into the nozzle by the wiper upon execution of wiping. Thus, the ink consumption amount in preliminary discharge is large.

(Preliminary Discharge Operation of First Embodiment)

Figure 5A:
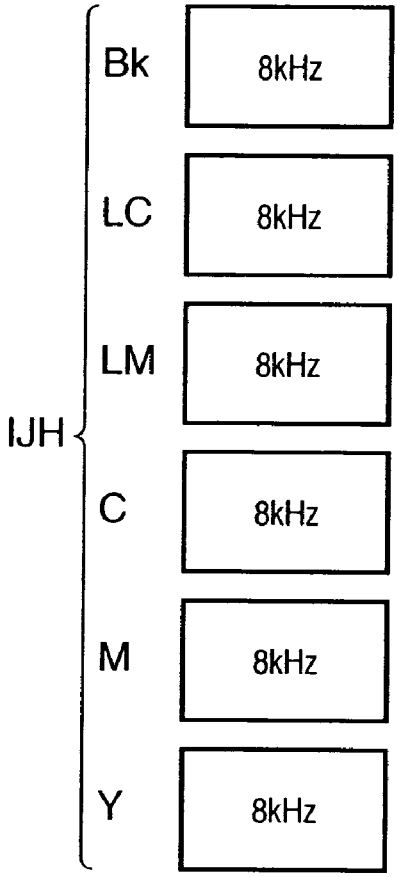
FIGS. 5A and 5B are views schematically showing a preliminary discharge operation as time progresses according to the first embodiment.
Figure 5B:
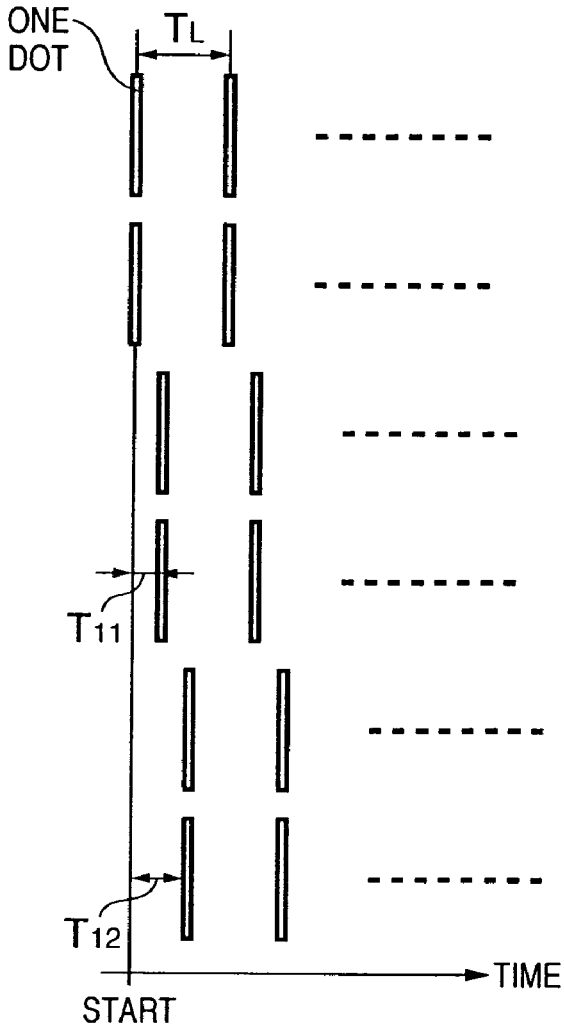

Preliminary discharge performed in the above sequence will be described in detail with reference to FIGS. 5A and 5B. FIG. 5A shows the driving state of each printing head in preliminary discharge according to the first embodiment. FIG. 5B schematically shows ink discharged by preliminary discharge as time progresses.

As described above, in the printer according to the first embodiment, the maximum driving frequency of each printing head is 24 kHz, and the ink supply ability of the ink tank is 8 kHz for single-color full discharge. The number of nozzles simultaneously drivable by the power supply is 1,024, which corresponds to all the nozzles of two printing heads.

Preliminary discharge operation for each printing head will be explained. Preliminary discharge is performed once by all Bk and LC nozzles (two-color full discharge). Upon the lapse of 41.66 μs (corresponding to the 24-kHz maximum driving frequency interval of the printing head) represented by $T_{11}$ in FIG. 5B, preliminary discharge is performed once by all LM and C nozzles. Upon the lapse of 41.7 μs again, i.e., upon the lapse of 41.66×2=83.33 μs=$T_{12}$ after preliminary discharge for Bk and LC, preliminary discharge is performed once by all M and Y nozzles.

This processing is repeated a predetermined number of times in a cycle of 125 μs=$T_L$ corresponding to an interval of 8 kHz.

In preliminary discharge operation of the first embodiment, the number of nozzles simultaneously driven at each timing is 1,024, which falls within the range of the supply ability of the power supply. The driving frequency for each printing head is 8 kHz, as shown in FIG. 5A, which also falls within the range of the ink supply ability of the ink tank.

The time $T_{11}$ till the start of preliminary discharge for LM and C after the start of the preliminary discharge operation for Bk and LC is 41.66 μs, and the time $T_{12}$ till the start of preliminary discharge for M and Y is 83.33 μs. Since the times $T_{11}$ and $T_{12}$ are 0.0625 (sec) and 0.125 (sec) in conventional preliminary discharge, the first embodiment shortens the times $T_{11}$ and $T_{12}$ to 1/1500. Preliminary discharge is performed in a state in which spread of color-mixed ink hardly progresses in the nozzle of the printing head. Thus, color mixing can be avoided by a relatively small number of preliminary discharge operations, and the ink amount consumed by preliminary discharge can be reduced.

Compared to conventional preliminary discharge for the total time taken for preliminary discharge, the total time taken for preliminary discharge is 0.1875 (sec) in conventional preliminary discharge but 125×500+83.33=62625 μs≈0.0626 (sec) in the first embodiment when the number of preliminary discharge operations is 500. The total time can be shortened to about 1/3.

Second Embodiment

The second embodiment of the present invention will be described. Similar to the first embodiment, the second embodiment also concerns an ink-jet printer. A description of the same parts as those in the first embodiment will be omitted, and the features of the second embodiment will be mainly explained.

Figure 6A:
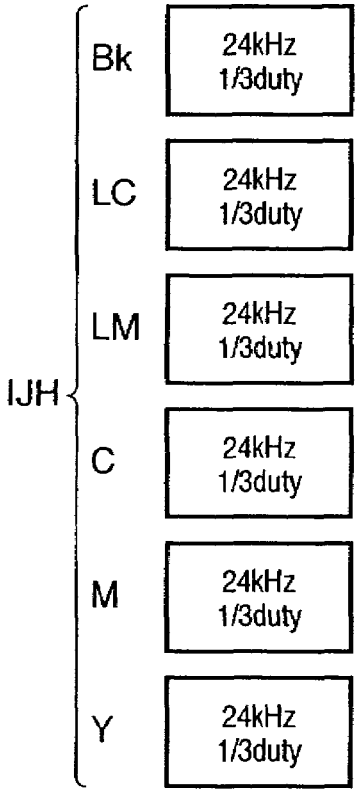
FIGS. 6A and 6B are views schematically showing a preliminary discharge operation as time progresses according to the second embodiment.
Figure 6B:
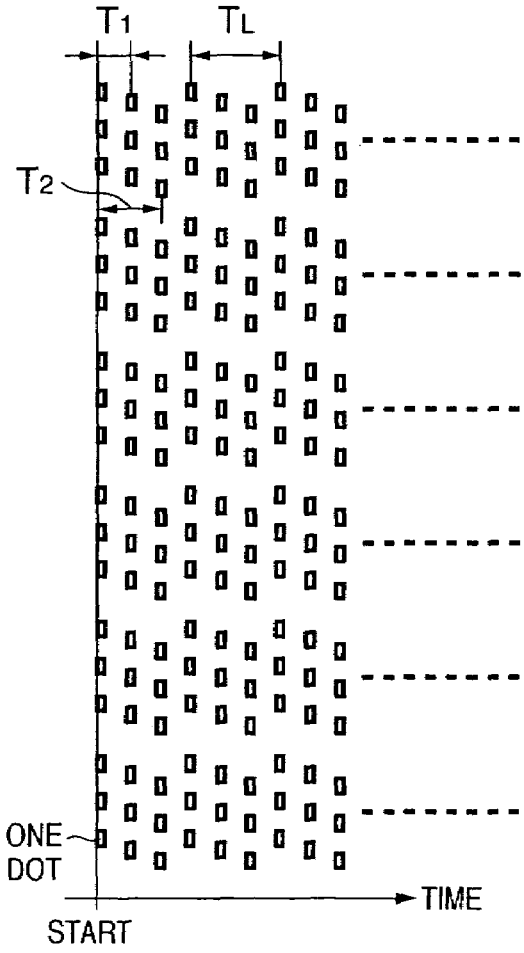

Similar to FIGS. 5A and 5B, FIG. 6A shows the driving state of each printing head in preliminary discharge according to the second embodiment. FIG. 6B schematically shows ink discharged by preliminary discharge as time progresses. The preliminary discharge operation according to the second embodiment will be explained with reference to FIGS. 6A and 6B.

Also in the printer according to the second embodiment, the maximum driving frequency of each printing head is 24 kHz, and the ink supply ability of the ink tank is 8 kHz for single-color full discharge. The number of nozzles simultaneously drivable by the power supply is 1,024, which corresponds to all the nozzles of two printing heads.

In the second embodiment, as shown in FIG. 6A, preliminary discharge is performed by driving each printing head at a duty of 1/3. In this case, as shown in FIG. 6B, the printing heads are driven by a discharge pattern in which the numbers of driven nozzles of the printing heads become equal to each other.

In the pattern shown in FIG. 6B, preliminary discharge starts simultaneously by the printing heads of all colors. The driving frequency of each printing head is a maximum frequency (24 kHz). More specifically, 171 nozzles having nozzle numbers 1 to 85 and 257 to 342 are first driven in each printing head. Upon the lapse of 41.66 μs corresponding to an interval of 24 kHz represented by $T_1$, 171 nozzles having nozzle numbers 86 to 171 and 343 to 427 are driven. Upon the lapse of 83.33 μs represented by $T_2$ after the start of preliminary discharge, 170 nozzles having nozzle numbers 172 to 256 and 428 to 512 are driven.

This processing is repeated a predetermined number of times in a cycle of 125 μs=$T_L$ corresponding to an interval of 8 kHz.

In preliminary discharge operation of the second embodiment, the number of nozzles simultaneously driven at each timing is 1,024, which falls within the range of the supply ability of the power supply. The driving frequency for each printing head is 24 kHz, which falls within the range of the ink supply ability of the ink tank because the number of simultaneously driven nozzles is 1/3.

In this fashion, according to the second embodiment, preliminary discharge can be started simultaneously for all colors. The start time of preliminary discharge is not different between inks, and the same preliminary discharge operation can be performed for inks. The states of all inks can be kept uniform.

Also in the second embodiment, similar to the first embodiment, preliminary discharge is performed in a state in which spread of color-mixed ink hardly progresses in the nozzle of the printing head. Color mixing can be canceled by a relatively small number of preliminary discharge operations, and the ink amount consumed by preliminary discharge can be reduced. Compared to conventional preliminary discharge, the total time taken for preliminary discharge can be shortened to about ⅓.

In the second embodiment, the duty is decreased to ⅓. The ink amount simultaneously removed from one printing head decreases to ⅓. However, the ink amount supplied from the ink tank at a time interval (125 μs) corresponding to a frequency of 8 kHz is the same as that in the first embodiment.

The second embodiment has been described on the assumption that the driving duty in preliminary discharge is ⅓ and the driving frequency is 24 kHz. The duty value can be set to a value at which inks in the respective colors can be simultaneously discharged as long as the duty falls within the ink supply ability of the ink tank.

That is, when the ink supply ability (=ink removal efficiency) from one ink tank is represented by a single-color full discharge enable frequency, the duty can be set within the range of preliminary discharge duty×driving frequency≦single-color full discharge enable frequency However, since the ink removal efficiency is preferably maximized for removing color-mixed ink within a short time and minimizing the time taken for preliminary discharge, preliminary discharge is preferably performed under a condition:

preliminary discharge duty×driving frequency=single-color full discharge enable frequency

Third Embodiment

The third embodiment of the present invention will be described. Similar to the first embodiment, the third embodiment also concerns an ink-jet printer. A description of the same parts as those in the first embodiment will be omitted, and the features of the third embodiment will be mainly explained.

Similar to FIGS. 5A, 5B, 6A, and 6B, FIG. 7A shows the driving state of each printing head in preliminary discharge according to the third embodiment. FIG. 7B schematically shows ink discharged by preliminary discharge as time progresses. The preliminary discharge operation according to the third embodiment will be explained with reference to FIGS. 7A and 7B.

Also in the printer according to the third embodiment, the maximum driving frequency of each printing head is 24 kHz, and the ink supply ability of the ink tank is 8 kHz for single-color full discharge. The number of nozzles simultaneously drivable by the power supply is 1,024, which corresponds to all the nozzles of two printing heads.

Figure 7A:
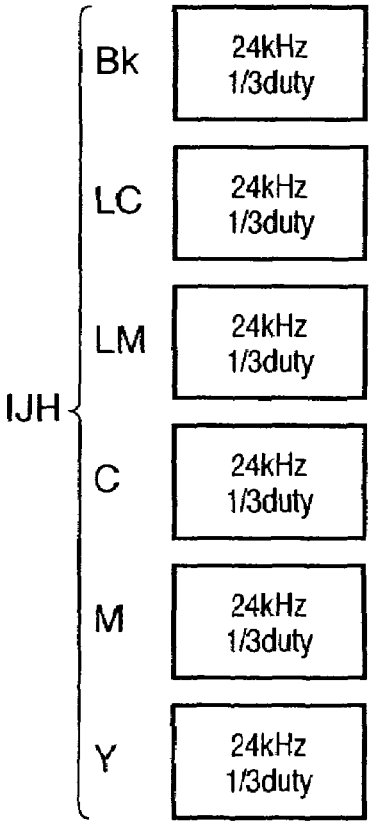
FIGS. 7A and 7B are views schematically showing a preliminary discharge operation as time progresses according to the third embodiment.
Figure 7B:
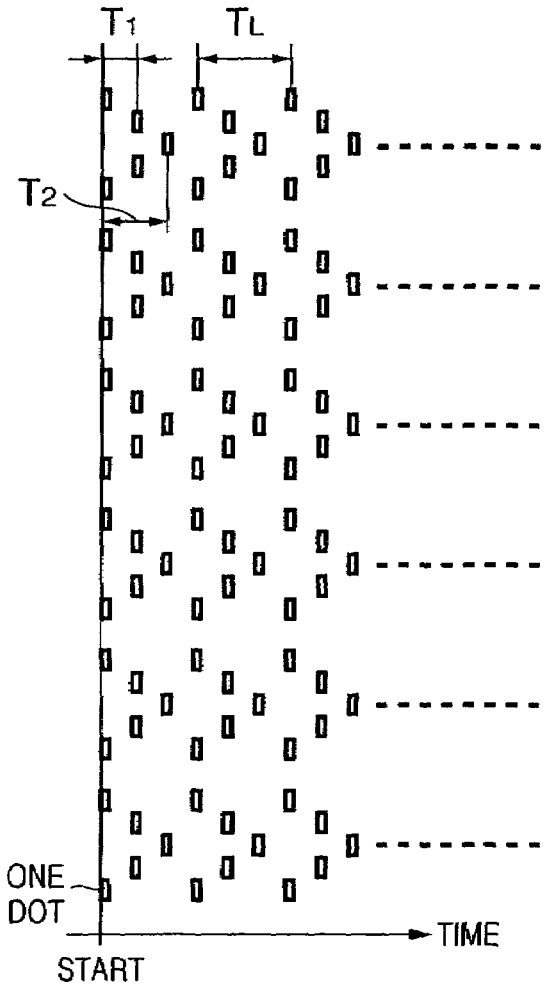

Similar to the second embodiment, in the third embodiment, as shown in FIG. 7A, preliminary discharge is performed by driving each printing head at a duty of ⅓. In this case, as shown in FIG. 7B, the printing heads are driven by a discharge pattern in which the numbers of driven nozzles of the printing heads become equal to each other and ink flows inward in the liquid chamber.

Figure 8:
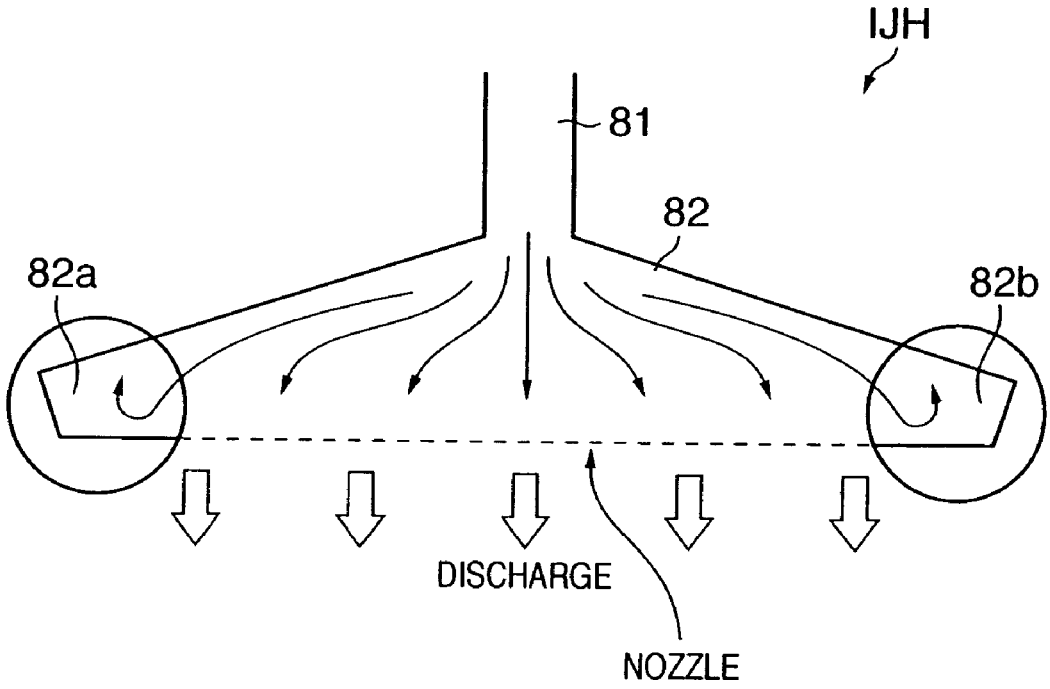
FIG. 8 is a sectional view schematically showing the ink flow inside the printing head.

FIG. 8 is a sectional view schematically showing the ink flow inside the printing head. When ink is discharged simultaneously from all the nozzles of the printing head IJH, as shown in FIG. 8, ink is supplied from a liquid channel 81 to a liquid chamber 82, but stagnates at end portions 82*a* and 82*b* of the liquid chamber. Mixed-color ink near the center of the liquid chamber is efficiently removed by preliminary discharge. To remove mixed-color ink near the end portions 82*a* and 82*b* of the liquid chamber, the ink removal amount by preliminary discharge must be increased.

In the third embodiment, to prevent a decrease in removal efficiency caused by the ink flow, ink near the end portions 82*a* and 82*b* of the liquid chamber is removed to form ink flows from the end portions to the center within the liquid chamber 82. As a result, color-mixed ink near the end portions is efficiently removed.

In the pattern shown in FIG. 7B, preliminary discharge starts simultaneously by the printing heads with a pattern in which ink flows from the end portion to the center. The driving frequency of each printing head is a maximum frequency (24 kHz). More specifically, 171 nozzles having nozzle numbers 1 to 85 and 427 to 512 are first driven in each printing head. Upon the lapse of 41.66 μs corresponding to an interval of 24 kHz represented by $T_1$, 171 nozzles having nozzle numbers 86 to 171 and 342 to 426 are driven. Upon the lapse of 83.33 μs represented by $T_2$ after the start of preliminary discharge, 170 nozzles having nozzle numbers 172 to 341 are driven.

This processing is repeated a predetermined number of times in a cycle of 125 μs=$T_L$ corresponding to an interval of 8 kHz.

As described above, the third embodiment performs almost the same preliminary discharge operation as that in the second embodiment except for the nozzle driving pattern in preliminary discharge. As the effects of the third embodiment, in addition to those of the second embodiment, color-mixed ink at the end portion of the liquid chamber can be efficiently removed.

Also in the third embodiment, similar to the second embodiment, the duty value can be set to a value at which inks in the respective colors can be simultaneously discharged as long as the duty falls within the ink supply ability of the ink tank.

The preliminary discharge unit is the ink color in the above embodiments, but the present invention can also be applied to a printer having a plurality of nozzle arrays or printing heads of the same color. In this case, the nozzle arrays or printing heads are defined as a unit.

Other Embodiment

Each of the embodiments described above has exemplified a printer, which comprises means (e.g., an electrothermal transducer, laser beam generator, and the like) for generating heat energy as energy utilized upon execution of ink discharge, and causes a change in state of an ink by the heat energy. According to this ink-jet printer and printing method, a high-density, high-precision printing operation can be attained.

As the typical arrangement and principle of the ink-jet printing system, those practiced by use of the basic principle disclosed in, for example, U.S. Pat. Nos. 4,723,129 and 4,740,796 are preferable. The above system is applicable to either one of the so-called on-demand type and continuous type. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal.

By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with particularly high response characteristics.

As the pulse driving signal, signals disclosed in U.S. Pat. Nos. 4,463,359 and 4,345,262 are suitable. Note further that excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region, is also included in the present invention.

In addition, not only an exchangeable chip type printhead, as described in the above embodiment, which can be electrically connected to the apparatus main unit and can receive an ink from the apparatus main unit upon being mounted on the apparatus main unit but also a cartridge type printhead in which an ink tank is integrally arranged on the printhead itself can be applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

The present invention can be applied to a system comprising a plurality of devices (e.g., host computer, interface, reader, printer) or to an apparatus comprising a single device (e.g., copying machine, facsimile machine).

Further, the object of the present invention can also be achieved by providing a storage medium storing program codes for performing the aforesaid processes to a computer system or apparatus (e.g., a personal computer), reading the program codes, by a CPU or MPU of the computer system or apparatus, from the storage medium, then executing the program.

In this case, the program codes read from the storage medium realize the functions according to the embodiments, and the storage medium storing the program codes constitutes the invention.

Further, the storage medium, such as a floppy disk, a hard disk, an optical disk, a magneto-optical disk a CD-ROM, a CD-R a magnetic tape, a non-volatile type memory card and a ROM, can be used for providing the program codes.

Furthermore, besides aforesaid functions according to the above embodiments being realized by executing the program codes which are read by a computer, the present invention also includes a case where an OS (operating system) or the like working on the computer performs parts or entire processes in accordance with designations of the program codes and realizes functions according to the above embodiments.

Furthermore, the present invention also includes a case where, after the program codes read from the storage medium are written in a function expansion card which is inserted into the computer or in a memory provided in a function expansion unit which is connected to the computer, a CPU or the like contained in the function expansion card or unit performs parts or entire processes in accordance with designations of the program codes and realizes functions of the above embodiments.

If the present invention is realized as a storage medium, program codes for performing the preliminary discharge of the above mentioned patterns (shown in FIGS. 5A and 5B, 6A and 6B and/or 7A and 7B) are to be stored in the storage medium.

As is apparent, many different embodiments of the present invention can be made without departing from the spirit and scope thereof, so it is to be understood that the invention is not limited to the specific embodiments thereof except as defined in the appended claims.

What is claimed is:

1. An ink-jet printing apparatus which comprises a plurality of printing heads, each having an array of ink discharging elements, and prints by discharging ink from the elements onto a printing medium, comprising:

preliminary discharge performing means for performing, a predetermined number of times, driving of the elements of one printing head in performing preliminary discharge of ink unrelated to printing;

printing head switching means for switching, in a predetermined cycle, the one printing head for which the preliminary discharge is to be performed to at least one other printing head; and control means for controlling said preliminary discharge performing means and said printing head switching means so as to perform the preliminary discharge the predetermined number of times for all the elements of the plurality of printing heads by repeating the predetermined cycle a plurality of times, wherein the predetermined cycle includes a cycle corresponding to a maximum frequency at which each printing head can be driven.

* * * * *